US005396785A

United States Patent [19]

Chen

[11] Patent Number: 5,396,785

[45] Date of Patent: Mar. 14, 1995

[54] COMBINATION PADLOCK WITH AN IMPROVED ROCKER ASSEMBLY AS LOCKING CONTROL DEVICE

[76] Inventor: Han T. Chen, 32-1, Yen Tso Lane, Hai Pu Lee, Lu Kang Chen, Chang Hua Hsien, Taiwan, Prov. of China

[21] Appl. No.: 135,689

[22] Filed: Oct. 13, 1993

[51] Int. Cl.[6] ..... E05B 37/14

[52] U.S. Cl. ..... 70/25; 70/53; 70/312

[58] Field of Search ..... 70/29, 25, 26, 53, 312

[56] References Cited

U.S. PATENT DOCUMENTS

| | | | |
|---|---|---|---|
| 1,117,417 | 11/1914 | Meepos | 70/29 |
| 4,866,959 | 9/1989 | Ling | 70/25 |
| 4,899,559 | 2/1990 | Chern | 70/25 |

FOREIGN PATENT DOCUMENTS

| | | | |
|---|---|---|---|
| 2227515 | 8/1990 | United Kingdom | 70/25 |

*Primary Examiner*—Lloyd A. Gall
*Attorney, Agent, or Firm*—W. Wayne Liauh

[57] ABSTRACT

A combination padlock with an improved rocker assembly as looking control device. The combination padlock contains a slide plate, a rocker assembly, a shackle, a predetermined number of numbered wheels, and a plurality of wheel sleeves respectively matching the numbered wheels. The slide plate is provided with a predetermined number of semicircular holes, each of the semicircular holes is adapted for receiving a spring and one of the wheel sleeves. An oblong hole is located between two of the semicircular holes, each of the semicircular holes is further provided with an angled flange corresponding in angle and dimension to a notch provided in each of the wheel sleeves. When a correct combination is dialed, the notches match the angles and the lock is unlocked. The rocker assembly contains a rocking hole, a retaining bar, and a rocking shaft. The rocking hole is dimensioned as to fit over a protuberance on the lower housing of the padlock such that the rocker assembly can be caused to pivot about the protuberance. The retaining bar is capable of being caused, by a downward movement of the slide plate, to move to retain a retaining head of the shackle when the angled flange of any one of the semicircular holes of the slide plate is not coincident with a coinciding notch of the wheel sleeves, thereby causing the shackle to be locked.

1 Claim, 4 Drawing Sheets

COMBINATION PADLOCK WITH AN IMPROVED ROCKER ASSEMBLY AS LOCKING CONTROL DEVICE

FIELD OF THE INVENTION

The present invention relates generally to a combination padlock, and more particularly to a rocker assembly control device for use with a combination padlock.

BACKGROUND OF THE INVENTION

There are a variety of locks; nevertheless the locks are generally classified, on the basis of their construction, into the combination locks and the key locks, which have both advantages and disadvantages. In a way, the popular combination padlock is the better of the combination locks and the key locks. However, the conventional combination padlock has shortcomings, which are expounded explicitly hereinafter.

The cost of making the conventional combination padlock is relatively high in view of the fact that the construction of the conventional combination padlock is complicated and that the quality control of the conventional combination padlock cannot be carried out effectively and economically.

The shackle of the conventional combination padlock can be pulled out accidentally at the time when the shackle is not arrested and retained by all dial sleeves. In addition, there are many gaps in the housing of the padlock in which the dial and other component parts are housed. Such gaps can be used by an unauthorized person to unlock the combination padlock with a device.

The locking and the unlocking mechanisms of the conventional combination padlock involve a number of frictional contacts between the shackle and each of the dial sleeves. As a result, the operation of the conventional combination padlock is painfully slow.

The unlocking mechanism of the conventional combination padlock is inefficient on the grounds that the working of the shackle is not assisted by a spring.

SUMMARY OF THE INVENTION

It is therefore the primary objective of the present invention to provide a combination padlock with a rocker assembly control device capable of overcoming the drawbacks of the prior art combination padlock described above.

The primary objective of the present invention is attained by a rocker assembly control device of combination padlock, which makes use of a numbered wheel to regulate the linear motion of a slide plate. The rocker assembly is so driven by the slide plate as to oscillate. The oscillating motion of the rocker assembly actuates the retaining bar to turn so as to regulate the locking and the unlocking actions of the shackle is provided with a recess which enables the shackle to be placed in appropriate locked and unlocked positions automatically. Such automatic locating of the locking and the unlocking ends of the shackle is further enhanced by means of a compression spring disposed at a predetermined position from the shackle.

DETAILED DESCRIPTION OF THE INVENTION

Figure 1:
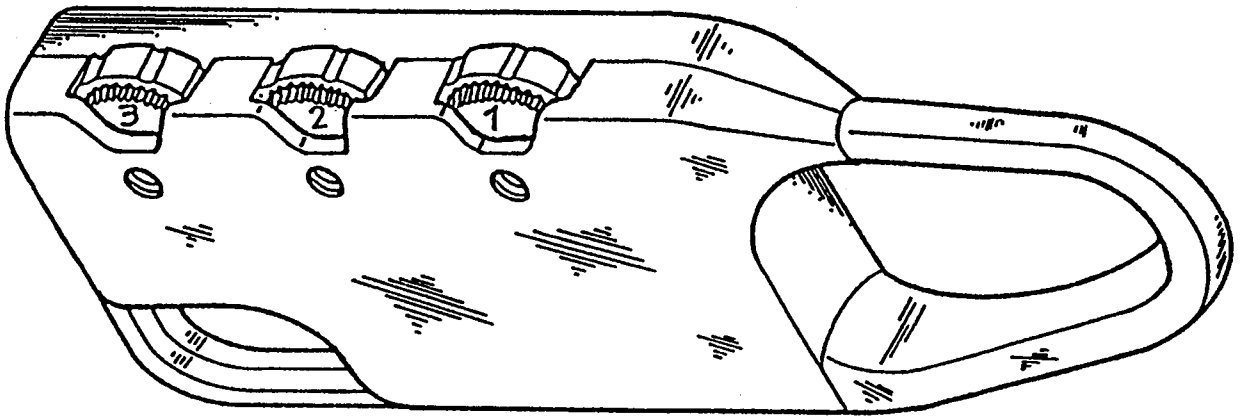
FIG. 1 shows a perspective view of the present invention.
Figure 2:
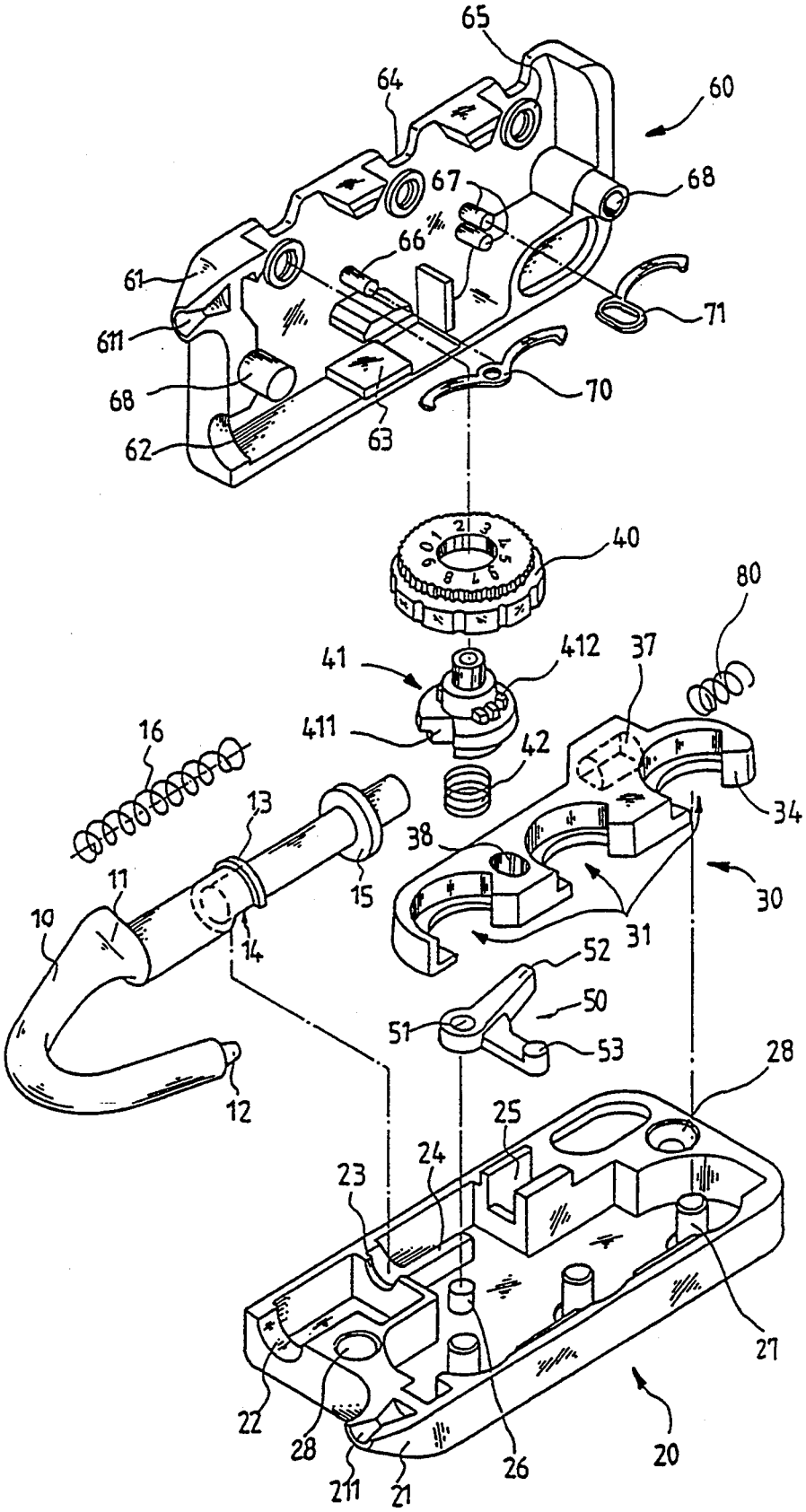
FIG. 2 shows an exploded view of the present invention.

As shown in FIG. 2, a shackle 10 of a U-shaped construction is provided with an enlarged portion 11, a protruded end 12, a midsection provided with a flange 13 and a recess 14, and a lower section provided with a retaining head 15 received in a slot 25 of a lower housing 20. The lower housing 20 comprises a semicircular groove 23 dimensioned to receive the flange 13, and a vertical bar 24 connecting with and perpendicular to the semicircular groove 23. The vertical bar 24 is intended to urge the retaining head 15 of the shackle 10. A compression spring 16 is disposed in the midsection of the shackle 10 and is intended to urge the retaining head 15 to press against the front end surface of the slot 25. The lower housing 20 is provided respectively in both sides of the front end thereof with a semicircular groove 22 and an inner conical hole 211. The lower housing 20 is further provided with three pillars 27 for locating a slide plate 30, three numbered wheels 40, three wheel sleeves 41, and three springs 42 urging the three wheel sleeves 41. The lower housing 20 is provided in the interior thereof with a protuberance 26 dimensioned to fit into a rocking hole 51 of a rocker assembly 50, which has a retaining bar 52 serving to stop the retaining head 15 so as to allow the shackle 10 to move downwards to be retained. Like the lower housing 20, an upper housing 60 is provided with a semicircular groove 62 and an inner conical hole 611, which are corresponding respectively in location to the semicircular groove 22 and the inner conical hole 211 of the lower housing 20. The upper housing 60 is further provided with three round holes 65 corresponding in location to the three pillars 27 of the lower housing 20. The upper housing 60 is still further provided with a pillar 66 and two pillars 67 disposed side by side. These pillars 66 and 67 are used to locate two elastic pieces 70 and 71. The upper housing 60 has two locating shafts 68 corresponding in location to two locating holes 28 of the lower housing 20. The locating shafts 68 are dimensioned to fit into the locating holes 28. The upper housing 60 has a semicircular flange 61, an inner conical hole 611, a semicircular groove 62, a slot 63, a groove 64 through which the numerals and/or the letters can be seen. The slide plate 30 is provided with three semicircular holes 31 in which the three wheel sleeves 41 are disposed respectively. Each of the three semicircular holes 31 is provided with an angled flange 34 serving to cooperate with a notch 411 of the wheel sleeve 41. Located under a protruded portion of the slide plate 30 is a long hole 37 for receiving therein a spring 80. Located between the two semicircular holes 31 is an oblong hole 38 having a depth corresponding to a height of the rocker assembly 50. The oblong hole 38 is dimensioned to fit over a rocking shaft 53 of the rocker assembly 50. The three wheel sleeves 41 are respectively disposed in the three semicircular holes 31 of the slide plate 30 such that the three wheel sleeves 41 are respectively located by the three pillars 25. The notch 411 of the wheel sleeves 41 is corresponding in dimension and angle to the angled flange 34 of the slide plate 30.

Each of the three wheel sleeves 41 is provided with a plurality of projections 412 engageable with the serrated block of the numbered wheel 40 having a short diameter and a long diameter. The numbered wheel 40 is provided in the circumference of the short diameter thereof with a finely serrated surface. Located in the circumference of the long diameter of the numbered wheel 40 are a plurality of recesses corresponding in location and number to the numerals marked on the numbered wheel 40. These recesses of the numbered wheel 40 serve to facilitate the dialing of the numbered wheel 40.

The rocker assembly 50 is another feature of the present invention. The rocker assembly 50 is provided with a rocking hole 50 dimensioned to fit over the protuberance 26 of the lower housing 20, and with a retaining bar 52, and further with a rocking shaft 53 dimensioned to fit into the oblong hole 38 of the slide plate 30. The retaining bar 52 serves to retain and stop the retaining head 15 of the shackle 10 at the time when the rocker assembly 50 is driven by the slide plate 30 in the locking process.

Figure 3:
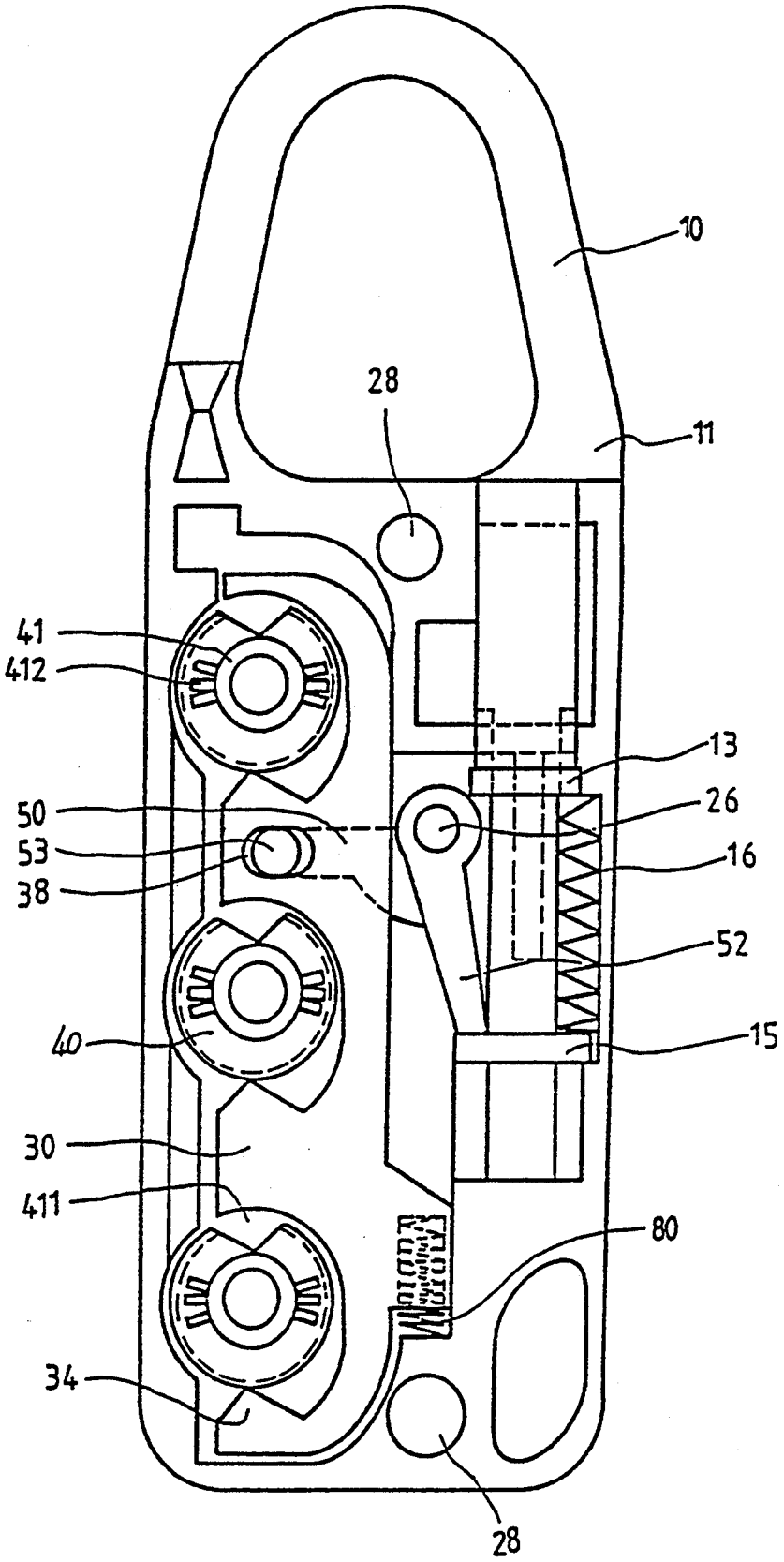
FIG. 3 is a plan schematic view showing that the present invention is in a locking state.

The locking state of the present invention is illustrated in FIG. 3, in which the angled flange 34 of the slide plate 30 is not joined with the notch 411 of the wheel sleeve 41. As a result, the slide plate 30 is caused to move downwards in a linear manner, thereby resulting in the rotation of the rocking shaft 53 which is located in the oblong hole 38 of the slide plate 30. Therefore, the rocker assembly 50 is capable of oscillating on the protuberance 26 which is fitted into the rocking hole 51 of the rocker assembly 50, thereby causing the retaining bar 52 of the rocker assembly 50 to retain the retaining head 15 of the shackle 10. As a result, the shackle 10 is so securely retained that it can not be pulled out.

Figure 4:
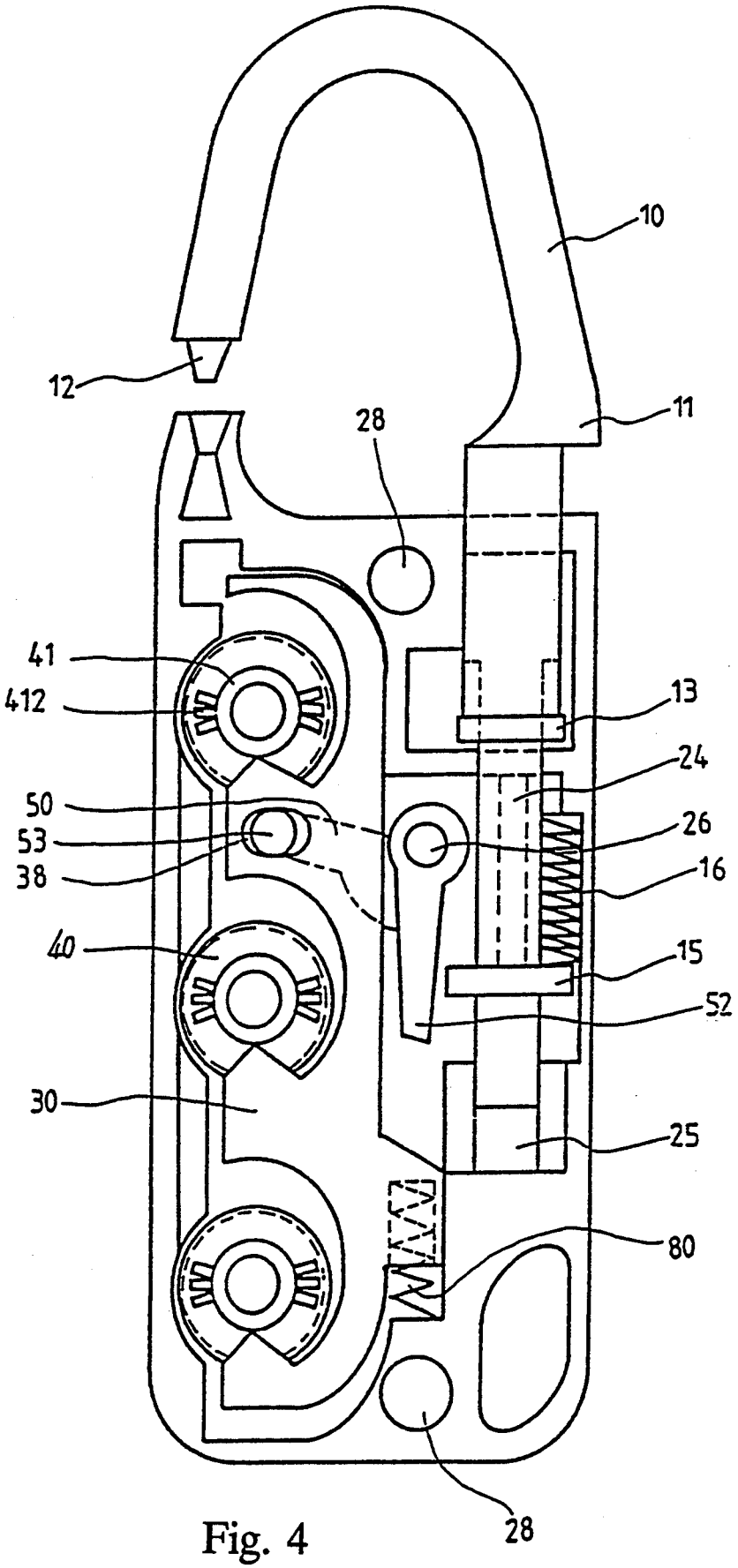
FIG. 4 is a plan schematic view showing that the present invention is in an unlocking state.

As shown in FIG. 4 the numbered wheels 40 are 10 so dialed that a set series of numbers are arranged in a correct combination. As a result, the three angled flanges 34 of the slide plate 30 coincide with the three notches 411 of the three wheel sleeves 41. The slide plate 30 is caused by the spring 80 to move upwards, thereby resulting in the upward movement of the rocking shaft 53 of the rocker assembly. The Upward movement of the rocking shaft 53 causes the retaining bar 52 of the rocker assembly 50 to turn away from the retaining head 15 of the shackle 10, thereby permitting the shackle 10 to be pulled out. The padlock of the present invention is therefore unlocked.

The advantages inherent in the present invention are described further hereinafter.

The manufacturing process of the combination padlock of the present invention is so streamlined that the job of the quality control can be done more effectively, and that the cost of making the padlock is substantially reduced, thanks to the rocking rod of a simple construction.

The locking and the unlocking mechanisms of the shackle of the present invention is controlled by the rocker assembly control device. In other words, the movement of the slide plate is regulated by the wheel sleeves. The movement of the slide plate actuates the oscillation of the rocker assembly, which in turn regulates the locking and the unlocking mechanisms of the shackle. As a result, the mechanical friction among the component parts is reduced to a minimum, thereby prolonging the service lifespan of the combination padlock.

With the exception of the numbered wheels, all other component parts are well concealed in the body of the combination padlock of the present invention. In addition, the control device of the rocker assembly is protected securely by the padlock body which contains no gap permitting a foreign object to be inserted thereinto. In other words, the combination padlock of the present invention can not be tampered with.

The reliability and the safety of the combination padlock of the present invention is greatly enhanced in view of the fact that the shackle can not be unlocked easily by someone who does not have an access to the correct combination of numbers, and that the shackle can be located with ease and speed at the locking position where the shackle is retained securely.

The embodiment of the present invention described above is to be regarded in all respects as merely illustrative and not restrictive. Accordingly, the present invention may be embodied in other specific forms without deviating from the spirit thereof. The present invention is therefore to be limited only by the scope of the following appended claim.

What is claimed is:

1. A combination padlock comprising a slide plate, a rocker assembly, a shackle, a predetermined number of numbered wheels a plurality of wheel sleeves respectively matching said numbered wheels, a lower housing, and an upper housing; wherein said slide plate is provided with a predetermined number of semicircular holes, each of said semicircular holes being adapted for receiving a spring and one of said wheel sleeves, and an oblong hole located between two of said semicircular holes, each of said semicircular holes further being provided with an angled flange corresponding in angle and dimension to a notch provided in each of said wheel sleeves and capable of coinciding with said notch;

said rocker assembly is provided with a rocking hole, a retaining bar and a rocking shaft, said rocking hole being so dimensioned as to fit over a protuberance on said lower housing such that said rocker assembly can be caused to pivot about said protuberance, said rocking shaft being so dimensioned as to fit into said oblong hole of said slide plate such that said rocker assembly can be actuated by said slide plate to pivot about said protuberance, said retaining bar capable of being caused, by a downward movement of said slide plate, to move to retain a retaining head of said shackle when said angled flange of any one of said semicircular holes of said slide plate is not coincident with a coinciding notch of said wheel sleeves, thereby causing said shackle to be locked, said retaining bar further capable of being caused by an upward movement of said slide plate to release said retaining head from said shackle when said angled flange of each of said semicircular holes of said slide plate is coincident with said coinciding notch of each of said wheel sleeves, thereby causing said shackle to be unlocked;

said shackle comprising a bottom section, a middle section, a top section, with said retaining head being disposed between said bottom section and said middle section, a flange between said middle section and said top section, and a recess formed on said flange and said top section, said top section having a greater diameter than said middle section, said lower housing having a slot for receiving said bottom section of said shackle, and a semicircular groove for allowing said middle section and said shackle to be said shackle to travel therethrough, and said semicircular groove being smaller in diameter relative to said top section such that laid recess must be aligned with said semicircular groove in order for said shackle to be pushed downward to a locked position, said downward movement being stopped by said retaining head in conjunction with said slot of lower housing.

* * * * *